United States Patent [19]

Blenkinsop

[11] Patent Number: 4,497,133

[45] Date of Patent: Feb. 5, 1985

[54] PET DOOR WITH CONTROL CIRCUIT THEREFOR

[76] Inventor: Philip T. Blenkinsop, 56 Chapel La., Fowlmere, nr. Royston, Hertfordshire, England

[21] Appl. No.: 486,533

[22] Filed: Apr. 19, 1983

[30] Foreign Application Priority Data

Apr. 23, 1982 [GB] United Kingdom ..... 8211861

[51] Int. Cl.[3] ..... E05F 15/20

[52] U.S. Cl. ..... 49/31; 49/169; 119/51 R

[58] Field of Search ..... 49/31, 32, 169, 171, 49/478; 119/51 R

[56] References Cited

U.S. PATENT DOCUMENTS

| | | | |
|---|---|---|---|
| 3,465,724 | 9/1969 | Broadbent | 119/51 R |
| 3,897,753 | 8/1975 | Lee et al. | 119/51 R |
| 4,129,855 | 12/1978 | Rodrian | 119/51 R |
| 4,216,743 | 8/1980 | Cohen | 49/171 X |

*Primary Examiner*—Kenneth Downey

[57] ABSTRACT

A control circuit for unlatching a door, particularly a pet door, includes a transmitter coil (L1), a pulse driver (11) for pulse energising the coil, and a discriminator (12, 13) for detecting a.c. components in the coil current caused by currents induced in an outside tuned circuit brought adjacent the coil, e.g. around the neck of a pet seeking entry, and for comparing the frequency of the a.c. components with a standard. A latch drive circuit (14) responds to the discriminator for operating the door latch if the frequency comparison is satisfactory.

6 Claims, 2 Drawing Figures

PET DOOR WITH CONTROL CIRCUIT THEREFOR

The present invention is concerned with doors and is particularly concerned with a control circuit for unlatching a cat or pet door.

It is convenient to provide a cat door which enables a cat to enter or leave a house without disturbing people in the house. It is however less convenient if such a cat door allows access also to every cat in the neighbourhood.

It is an object of the present invention to provide a control circuit for a cat door latch that responds to the presence of a cat wearing a particular key to open the door and does not respond to the presence of other cats.

The present invention is a control circuit for unlatching a door and comprising a transmitter coil, means for pulse energising said coil, means for detecting a.c. components in the current in said coil and comparing them with a standard, and means responsive to the detecting and comparing means for operating the latch if said comparison is satisfactory.

The present invention is also a control circuit as defined in the last preceding paragraph in association with a tuned circuit whose resonant frequency compares satisfactorily with a standard frequency.

The present invention is further a door comprising a frame defining an opening, a flap pivotally mounted at its top about a horizontal axis and movable between a first position in which the opening is closed and a second position in which the opening is unobstructed, a latch extending to prevent movement of the flap from the first to the second position and a control circuit as defined in the second last preceding paragraph, said latch operating means moving the latch to allow movement of the flap from the first to the second position, and said coil being located at the periphery of the opening.

An embodiment of the present invention will now be described, by way of example, with reference to the accompanying drawings, in which.

Figure 1:
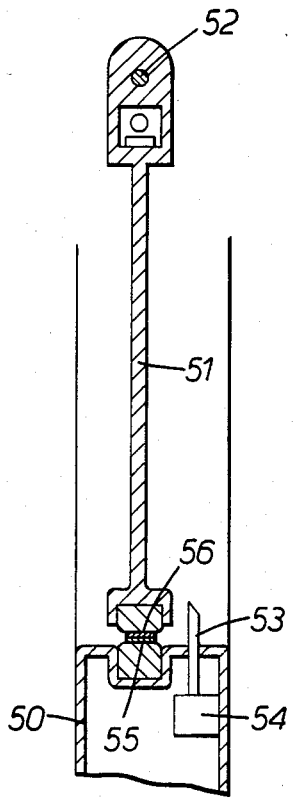
FIG. 1 is a cross section through a cat door.

Referring now to FIG. 1, a cat door comprises a frame 50 defining an aperture in which is located a flap 51 which is mounted in the frame 50 for pivotal movement about a horizontal axis 52 from the position shown, in which the flap 51 closes the aperture, to positions on either side of the central position to enable a cat to pass through the door. As shown the inside of the door is to the right and it can be seen that a cat at any time can pass out through the door i.e. from right to left but that entry of the cat from left to right requires that a latch 53 be withdrawn by energising a solenoid 54. The control circuit of FIG. 2 provides this energisation when a cat identified as the proper cat because it is wearing around its neck a "key", as will be explained later, seeks entry but will not energise the solenoid if any cat not wearing the appropriate key seeks entry.

To complete the picture of FIG. 1, the door aperture is sealed round its periphery by cooperating flexible magnetic strips 55 and 56 on the frame 50 and flap 51 respectively, and the latch 53 is located to permit an initial inward movement of the flap 51 before further movement is blocked.

Figure 2:
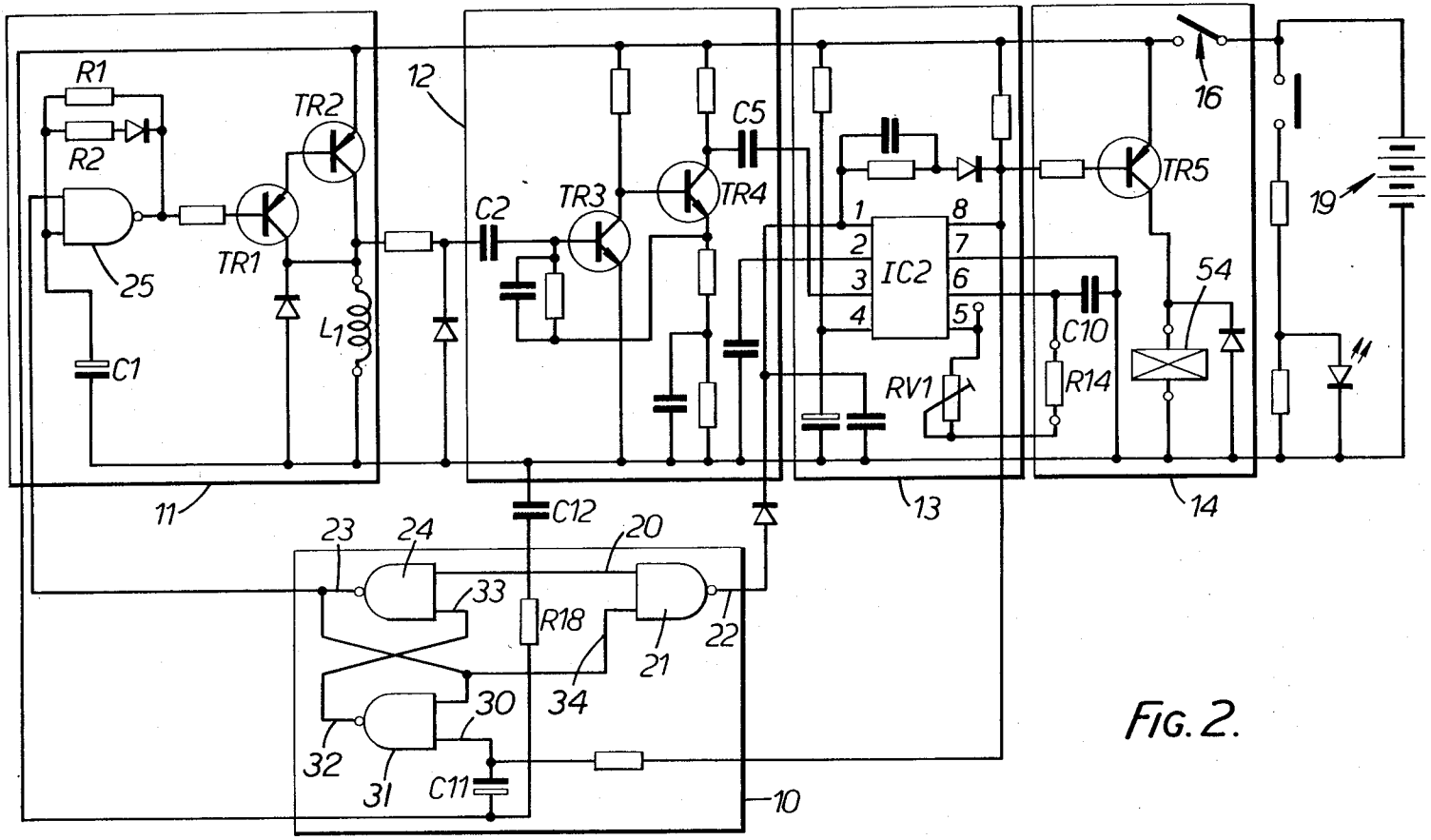
FIG. 2 is a control circuit used with the cat door of FIG. 1.

Referring now to FIG. 2, latch control circuitry for a door comprises a start-up logic circuit 10, a pulse driver circuit 11, an amplifier 12, a discriminator circuit 13 and a drive circuit 14 which includes the relay coil 54, which when energised withdraws the latch, and a reed switch 16 which is normally open but which is affected and closed by the magnetic sealing round the door when pressure is put on the door by a cat seeking entry and the door moves slightly until stopped by the latch.

When the reed switch 16 closes all the circuits are then energised from the battery 19 and a capacitor C12 commences charging through a resistor R18. This imposes a time delay until the input 20 of NAND gate 21 goes high and its output 22 goes low and removes an inhibiting input at pin 1 of an integrated circuit IC2, the time delay allowing the latch control circuitry to reach a steady state following closure of the reed switch 16.

The output 23 of gate 24 is high so the NAND gate 25 commences to supply low pulses to the base of transistor TR1 at a frequency determined by the time constant of the circuit R1, C1 and of a duration determined by the time constant of the circuit R2, C1. Typically the pulse duration may be 150 $\mu$s with a repeat time of 15 ms.

Each low pulse to the base of transistor TR1 renders it and transistor TR2 conducting and so energises a transmitter/detector coil L1 which is located around the periphery of the door aperture. The field produced by the coil L1 interacts with a tuned circuit in the adjacent key on the neck of the cat seeking entry causing a current in the tuned circuit, which current consists of a decaying a.c. current at the frequency determined by the tuned circuit. The field produced by the tuned circuit is picked up by the coil L1 and the a.c. component is passed by capacitor C2 to the base of transistor TR3, i.e. the input of transistor amplifier 12 comprising the transistors TR3 and TR4. A coupling capacitor C5 supplies the amplifier output to an input of an oscillator/discriminator circuit formed by IC2, which in this embodiment is an integrated circuit NE567 produced by Signetics. IC2 includes an internal oscillator whose frequency is determined by the external components C10, RV1 and R14, and the circuit operates to provide a low output on pin 8 when the input frequency from the amplifier on pin 3 is substantially equal to the internal oscillator frequency. In this way if the cat seeking entry is wearing a key whose tuned circuit operates at the correct frequency then pin 8 goes low, whereas any other cat seeking entry produces no effect and pin 8 remains high.

When pin 8 goes low, transistor TR5 in the drive circuit 14 is rendered conducting to energise the coil 54 and release the latch for a period determined by the discharge of a capacitor C11. C11 commences discharging because of the low voltage on pin 8 and the input 30 of NAND gate 31 then goes low which changes its output 32 to high which, applied to the input 33 of NAND gate 24, causes it to go low and this low at the input 34 of the NAND gate 21 causes its output 22 to go high and inhibit the oscillator in the integrated circuit IC2. This causes pin 8 to go high and thus deenergise the coil 54.

It can thus be seen that the power drain on the batteries is low as the circuit is not energised until a cat seeks entry and the coil 54 is only energised for a brief period sufficient to allow a cat to enter. It should be understood that when the door returns to its fully closed position the reed switch is no longer affected by the magnetic sealing strip so that the circuit is then deenergised.

The resistor R14 in the circuit which determines the oscillator frequency is formed as a plug-in component and is sold with the key. When R14 is then fitted to a door the oscillator frequency is then matched with the resonant frequency of the tuned circuit in the key. In this way, without requiring any adjustment of any circuit component, the door will discriminate even against cats wearing keys of the wrong frequency.

Modifications may be made to the embodiment described. For example, the reed switch 16 may be operated by a magnet provided on the flap for that specific purpose rather than by the magnetic sealing strip or it may be replaced by a microswitch operated by the flap.

I claim:

1. A control circuit for unlatching a door and comprising a transmitter coil, means for pulse energising said transmitter coil, means connected to said transmitter coil for detecting the frequency of a.c. components produced in the current in said transmitter coil by interaction of said transmitter coil with an outside object and for comparing the detected frequency with a standard frequency, and means responsive to the detecting and comparing means for operating the latch if said detected frequency is substantially equal to said standard frequency.

2. A control circuit as claimed in claim 1, including means associated with said detecting and comparing means for generating an internal oscillator frequency to define said standard frequency.

3. A control circuit as claimed in claim 1, including means for adjusting the standard frequency.

4. A control circuit as claimed in claim 1, in combination with a tuned circuit for interacting with said transmitter coil to produce said a.c. components.

5. A control circuit as claimed in claim 1, including a door comprising a frame defining an opening, a flap pivotally mounted at its top about a horizontal axis and movable between a first position in which the opening is closed and a second position in which the opening is unobstructed, a latch extending to prevent movement of the flap from the first to the second position, said latch operating means moving the latch to allow movement of the flap from the first to the second position, and said transmitter coil being located at the periphery of the opening.

6. A control circuit as claimed in claim 5, including switch means arranged to be operated by said flap for controlling energisation of components of said circuit when said flap is urged from the first toward the second position.

* * * * *

UNITED STATES PATENT AND TRADEMARK OFFICE

CERTIFICATE OF CORRECTION

PATENT NO. : 4,497,133

DATED : February 5, 1985

INVENTOR(S) : Philip T. BLENKINSOP

It is certified that error appears in the above-identified patent and that said Letters Patent is hereby corrected as shown below:

In the Heading of the Patent:

Please add the following:

Assignee: REILOR LIMITED, Lancashire, England

Signed and Sealed this

*Seventeenth* Day of *September 1985*

[SEAL]

*Attest:*

DONALD J. QUIGG

*Attesting Officer*

*Commissioner of Patents and Trademarks—Designate*